US006484418B1

(12) United States Patent
Hada et al.

(10) Patent No.: US 6,484,418 B1
(45) Date of Patent: Nov. 26, 2002

(54) YANKEE DRYING HOOD AND METHOD COMPRISING ANGLED IMPINGEMENT NOZZLES

(75) Inventors: Frank Hada, Appleton, WI (US); Ron Gropp, St. Catharines (CA)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/707,283

(22) Filed: Nov. 6, 2000

(51) Int. Cl.[7] ..... F26B 3/00

(52) U.S. Cl. ..... 34/487; 34/465; 34/122; 34/638

(58) Field of Search ..... 34/454, 465, 487, 34/422, 122, 633, 638; 162/290, 207, 359.1

(56) References Cited

U.S. PATENT DOCUMENTS

| | | | | |
|---|---|---|---|---|
| 3,181,250 | A | | 5/1965 | Vits |
| 3,370,359 | A | | 2/1968 | Beachler |
| 3,418,723 | A | | 12/1968 | Burgess et al. |
| 3,543,410 | A | | 12/1970 | Trachtenberg |
| 3,599,341 | A | | 8/1971 | Darcy et al. |
| 3,643,338 | A | | 2/1972 | Fair |
| 3,841,910 | A | | 10/1974 | Baker |
| 3,872,603 | A | | 3/1975 | Williams et al. |
| RE28,459 | E | | 7/1975 | Cole et al. |
| 3,981,084 | A | | 9/1976 | Sobota |
| 4,087,319 | A | | 5/1978 | Linkletter |
| 4,247,993 | A | | 2/1981 | Lindström |
| 4,297,794 | A | | 11/1981 | Luthi |
| 4,312,139 | A | * | 1/1982 | Preisler et al. ..... 34/54 |
| 4,320,582 | A | | 3/1982 | Klippstein et al. |
| 4,336,279 | A | | 6/1982 | Metzger |
| 4,364,185 | A | | 12/1982 | Dussourd et al. |
| 4,416,070 | A | | 11/1983 | Vedenpä et al. |
| 4,502,231 | A | | 3/1985 | Fissmann et al. |
| 4,505,052 | A | | 3/1985 | Osswald et al. |
| 4,513,517 | A | | 4/1985 | Vedenpää |
| 4,516,330 | A | | 5/1985 | Eskelinen et al. |
| 4,573,402 | A | | 3/1986 | Sharma et al. |
| 4,602,439 | A | | 7/1986 | Eskelinen et al. |
| 4,604,164 | A | | 8/1986 | Fujiwara et al. |
| 4,765,868 | A | | 8/1988 | Fujiwara |
| 4,779,355 | A | | 10/1988 | Petros |
| 4,906,333 | A | | 3/1990 | Myren |
| 4,915,788 | A | | 4/1990 | Winheim |
| 4,953,297 | A | | 9/1990 | Eskelinen et al. |
| 5,070,628 | A | | 12/1991 | Zagar |
| 5,086,571 | A | | 2/1992 | Hietanen |
| 5,110,416 | A | | 5/1992 | Linsuri et al. |
| 5,416,984 | A | | 5/1995 | Murray |
| 5,425,852 | A | | 6/1995 | Joiner |
| 5,471,766 | A | | 12/1995 | Heikkilä et al. |
| 5,540,406 | A | | 7/1996 | Occhipinti |
| 5,569,360 | A | | 10/1996 | Huovila et al. |
| 5,599,428 | A | | 2/1997 | Meinecke et al. |
| 5,738,760 | A | | 4/1998 | Svanqvist et al. |
| 5,891,309 | A | | 4/1999 | Page et al. |
| 5,944,958 | A | | 8/1999 | Svanqvist |
| 6,004,432 | A | * | 12/1999 | Page et al. ..... 162/281 |
| 6,018,886 | A | * | 2/2000 | Bell et al. ..... 34/380 |
| 6,085,437 | A | * | 7/2000 | Stipp ..... 34/115 |
| 6,094,838 | A | * | 8/2000 | Lang ..... 34/117 |

FOREIGN PATENT DOCUMENTS

| | | |
|---|---|---|
| CA | 677083 | 12/1963 |

* cited by examiner

*Primary Examiner*—Pamela Wilson
(74) *Attorney, Agent, or Firm*—Dority & Manning, P.A.

(57) ABSTRACT

A method, system and apparatus is disclosed for drying a wet web quickly and efficiently on the surface of a steam heated drying cylinder in a continuous papermaking process. A steam-heated drying cylinder having an exterior surface is rotated under a drying hood adjacent the exterior surface of the drying cylinder. The hood comprises a drying zone of heated air, with nozzles adapted to supply hot air streams into the drying zone. A wet web is adhered to the drying cylinder and rotated through the drying zone of the hood. Then, hot air streams are directed from the nozzles upon the wet web. A hot air stream is provided from a nozzle at a lead angle that deviates from perpendicular between about 3 and about 30 degrees, in a lead direction towards the downstream end of the web drying process.

20 Claims, 5 Drawing Sheets

YANKEE DRYING HOOD AND METHOD COMPRISING ANGLED IMPINGEMENT NOZZLES

BACKGROUND OF THE INVENTION

A common method of drying lightweight paper web products after manufacture of such webs is to adhere the wet web to the exterior surface of a steam heated Yankee dryer. A Yankee dryer is a cylindrical dryer that is heated internally by way of steam that passes through its interior, thereby supplying heat energy to the exterior surface of the dryer. While adhered to the Yankee dryer, supplemental drying is provided by an air impingement hood that blows high velocity, heated air onto the exposed surface of the paper web. The air must be provided at relatively high velocity and extremely high temperatures to adequately dry the wet web in the short amount of time that the wet web is exposed to the air.

Using a standard wet pressed paper manufacturing operation, the level of adhesion to a Yankee dryer by the wet web is generally high enough to prevent disruption of the sheet during the drying process. In many other manufacturing processes, the wet web may be undesirably disrupted (i.e. damaged) by the force of high velocity air impinging on the wet web. Disruption of the wet web causes portions of the sheet to come loose from the surface of the Yankee dryer. This leads to scorching of the paper web from the high temperature impingement air and ultimately to plugging of the hood causing fires.

Impingement nozzles apply air at high speed from a drying hood to the surface of a cylindrical dryer. In general, the space between the wet web on the cylindrical dryer and the hot air hood is only a few inches.

What is generally needed in the industry is an apparatus, system, and method that is capable of adequately drying the wet web while it rotates on a cylindrical drum, below the dryer hood. A system of applying hot air at useful velocities to adequately dry the web, while also avoiding disrupting the web on the surface of the dryer, is needed. Furthermore, a system that can achieve these results while stabilizing the wet web on the surface of the drying cylinder would be particularly useful.

SUMMARY OF THE INVENTION

In the application of this invention, several different embodiments are possible, and this specification is intended to show multiple embodiments. Other embodiments not shown herein are possible as within the spirit of the invention.

A web drying method is presented, the method comprising providing a rotating steam-heated drying cylinder having an exterior surface. Further, a drying hood is located adjacent the exterior surface of the drying cylinder, the hood comprising a drying zone of heated air, the hood further comprising nozzles adapted to supply hot air streams into the drying zone. A step of applying a wet web to the exterior drying surface of a cylinder is provided. Furthermore, a web is rotated upon the exterior surface of the cylinder through the drying zone of the hood. Hot air streams are directed from the nozzles upon the surface of the wet web. At least one hot air stream is provided from a nozzle at a lead angle that is deviated from perpendicular between about 3 and about 30 degrees.

In a further method of the invention, the web is secured to the surface of the cylinder while substantially avoiding disruption of the web upon the surface of the cylinder. In some instances, the lead angle is deviated from perpendicular between about 5 and 20 degrees. The lead angle, in other embodiments, is deviated from perpendicular about 10 degrees.

The method also is provided in which the web is traveling at a speed, relative to the hood, of between about 1,000 and 6,000 feet per minute. In some instances, the speed of the air stream exiting the nozzle is between about 20,000 and 30,000 feet per minute.

For some applications of the invention, the temperature of the hot air stream is between about 500 degrees Fahrenheit and about 1100 degrees Fahrenheit.

The nozzle direction may be angled towards the edges of the web from the midline, at a compound angle. That is, in some applications of the invention, the angle of the nozzles is deviated in two directions, one direction leading the web (alpha angle), and one direction along the axis of the rotating dryer (beta angle).

A method also is provided in which a hot air stream is directed at a deviation angle beta from perpendicular that increases as the nozzle distance from the midline increases. That is, the angle is greater out near the edges of the web, and smaller near the midline. There would be no compound angle (i.e., beta angle) at all at the midline, in most cases.

A web drying apparatus is provided in another embodiment of the invention. The apparatus comprises a rotating drying cylinder, the cylinder having an exterior drying surface adapted to receive a wet web. Further, the apparatus includes an air hood, the air hood comprising an air blowing means capable of providing a stream of high speed heated air upon a wet web on the exterior surface of the drying cylinder. A plurality of air nozzles are connected to the air hood, the air nozzles being oriented to eject air from the hood towards the drying cylinder at a predetermined angle alpha, the angle alpha being deviated from perpendicular between about 3 and about 30 degrees. Depending upon the web rotational speed, and the air speed, the appropriate lead angle of the nozzles may be only about 5–15 degrees.

In some applications of the invention, there is a deviation of the nozzle angle along both the alpha direction and a beta direction. That is, in some applications of the invention, the web further comprises a midline along its middle with a left and right edge, further wherein nozzles of the hood located on either side of the web midline. The nozzles eject hot air upon the web, wherein the direction of air ejected is angled towards the edge of the web in both the left and right directions. The nozzles on the left of the web generally are angled to the left edge of the web, while the nozzles located to the right of the web midline are directed or angled to the right edge of the web. The angle in the beta direction is known as a compound angle.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
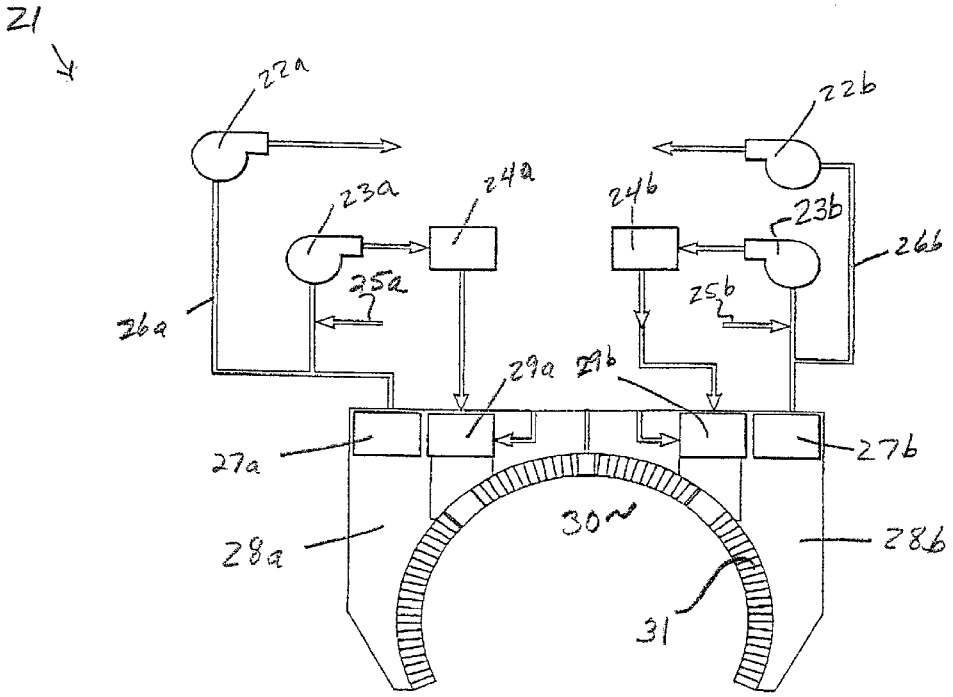
FIG. 1 is a schematic overview of the air hood and method of supplying hot air to the drying cylinder.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

In the invention, it is possible to reduce the disruption of a wet paper web during the impingement drying process of the web. The impingement holes or apertures which are provided in the wall of the supply plenum of the drying hood may be angled to provide a resultant velocity that is perpendicular to the paper web. That is, by providing a jet of air from the nozzles in a direction that is slightly deviated from perpendicular, i.e., deviated towards the downstream end of the wet web, it is possible to provide a resultant velocity vector of force that is approximately perpendicular to the paper web. In this way, velocity vectors that would tend to dislodge the paper from the surface of the Yankee dryer are minimized compared to conventional operation.

In the paper industry, hooded drying cylinders, i.e., Yankee dryers, are standard equipment for making a variety of lighter weight paper products such as tissues and paper towels. A dryer generally consists of a large rotating cylinder that is internally heated with steam. A major portion of the surface of the cylinder is enclosed by a hood which is continuously provided with hot air for drying the sheet and exhausting moisture. The wet paper web to be dried is briefly adhered to the outer surface of the rotating cylinder on a continuous basis. In a very short period of time, the wet web is provided in contact with the rotating cylinder, and most of the moisture is driven out of the web by a combination of surface heat on the surface of the dryer, and hot air impinging on the top or "air" surface of the sheet. Then, moisture is carried away by hot air circulating through the hood.

Typically, a dryer hood has two primary functions. One function is to supply hot air to the sheet surface to evaporate water from the sheet. A second purpose is to remove water vapor from the sheet area, thereby maintaining an acceptable drying rate of the wet web. High temperature hoods may supply up to about 70% of the total drying energy required by a machine.

In the drying of the web, it is generally known that a paper web may only be raised to about 36–40% consistency by pressing, and the rest of the water in a sheet or wet web must be removed by evaporation. A conventional method for evaporating the water has been to pass the wet web upon the surface of a drying cylinder which heats the web to the vaporization temperature of the water so that the water evaporates. Such drying cylinders are normally about 4–5 feet in diameter, but may be as wide as the machine, and can be much greater in diameter.

Drying cylinders typically are mounted in two horizontal rows so that the web may be wrapped around one in the top row and then around one in a bottom row. In general, the wet web travels back and forth between row cylinders until it is dry. However, in applications where the sheet has a relatively light weight a single roll of about 12–18 feet in diameter may be used, which dries the web in only one pass. For some applications several smaller drying cylinders are provided to further dry the sheet. This single roll type dryer is called a Yankee dryer and is typically used to dry light weight papers such as tissue. Heat may be transmitted from one material to another by conduction, radiation or convection. The transfer of heat from the dryer can to the paper is primarily by conduction. The surface of the dryer can may be polished steel, which is a poor radiator, and the temperature of the dryer cans usually cannot be raised to the high temperatures needed to reach a large enough emission level to make radiation feasible. The allowable working pressure of the Yankee cylinder limits the maximum possible het transfer that can be accomplished by the Yankee dryer alone. To increase the amount of heat transferred to the wet web an impingement drying hood is used. As the velocity of the air in the drying hood is increased the percentage of drying from the drying hood increases as the contribution from the Yankee dryer is generally fixed to its maximum.

Therefore, the amount of heat transferred by radiation is usually small, but some heat may be transferred by hot air that is trapped between the paper and the dryer surface. Conduction usually requires contact, and contact is not easy to achieve with paper. Paper is rough on the surface, being made of a random pile of fibers. Microscopic examination of the surface of the sheet of paper shows that the contact area between the web and a flat steel surface is not very great. Furthermore, as soon as the web contacts the hot dryer, water will be evaporated from the wet web surface, creating steam. This steam makes contact even more difficult between the wet web and the drying cylinder. A major obstacle to heat conduction, therefore, is a thin film of water vapor and air that sometimes is trapped between the wet web and the Yankee dryer cylinder surface. The rapid production of steam when a wet web is pressed against a Yankee dryer can tend to blow the wet web away from the Yankee dryer surface. Then tendency increases with increased moisture content of the wet web at initial contact.

Contact may be improved by pushing the wet web against the surface of the dryer using a pressure roll. The pressure roll is used in combination with a felt to remove water from the wet web, typically increasing the consistency to about 35% to 45%. For some applications, a woven fabric made from woven plastic filaments is used in combination with a pressure roll to adhere the sheet to the surface of the Yankee dryer. Since these fabrics do not absorb water there is substantially no water removal with these fabrics. Also, since the fabrics have a rigid woven structure only the knuckle points of the fabric are in contact with the surface of the Yankee dryer reducing the overall adhesion rate to the Yankee dryer. The use of woven fabrics, while beneficial for product reasons, can result in poor adhesion to the dryer.

Since in most cases the web is held tightly against the dryer surface, it is usually difficult for the water to be evaporated into the air spaces between the dryer and the wet web. This is especially true because air trapped in those spaces will rapidly become saturated with water vapor. Accordingly, it is very desirable for a machine to be designed for the efficient removal of hot moist air from this area of the dryer. A common means for controlling the air is using a dryer hood. The hood may be as small as a roof over the dryer section or it may be a complete building which encloses the entire dryer section. In a typical drying hood, a slot is provided for the wet web to pass into the heated zone of the hood and another slot is provided for the web to pass out of the dryer. These slots provide an air curtain seal to strip the boundary layer of air from the surface of the sheet to start drying the sheet rapidly, and at the discharge of the drying hood to strip off the layer of heated humid air from the sheet. In both of these hood designs, exhaust fans are usually provided to blow hot moist air from the exhaust side of the hood after it has been used for drying. The totally enclosed hood designs also are equipped with air inlet ports to control where the air is allowed to enter into the hood. The supply air is heated. Furthermore, control of the air in the dryer section may be accomplished by the forced introduction of hot dry air into the hood. The air is either released from slots in older drying hood designs or released from impingement nozzles, where it impinges upon the wet web at the surface of the drying cylinder.

Using a Yankee dryer, a wet web is pressed against the surface of the dryer while it is still at least about fifty percent moisture content. The web will then stick to the dryer can until the necessary drying is accomplished. For light weight sheets finished dryness is achieved with the drying hood and Yankee cylinder alone. For some heavier weight sheets, a series of smaller after-dryers are used as well.

Paper made using a Yankee dryer is generally of two types: uncreped or creped. Uncreped papers are removed from the Yankee dryer surface without further processing and are typically flat, glossy and of relatively low caliper. Another grade of paper made on a Yankee dryer is creped tissue. By scraping the web from the dryer, a web becomes wrinkled in the machine direction. This process is known as creping. Creping of the web causes the web to become shorter in the machine direction, and therefore subsequent sections of the machine are run more slowly to prevent pulling of the crepe out of the paper. The crepe gives the paper added softness, bulk and absorbency, which is why this method is a popular method for producing tissue.

Typically, tissue paper must be dried in only one pass around the Yankee dryer can as creping is more effective at producing the required product attributes when the sheet is dry. It is therefore necessary to supply a large amount of energy above that provided by the thermal energy of the dryer can. Thus, this additional heat is supplied by hot air that is blown upon the surface of the web from hot air nozzles around the surface just above the Yankee dryer, that is, near the lower surface of the hood. Hot air is blown at relatively high velocities and high temperatures directly at the surface of the web. The high velocity air breaks through the layer of air and steam at the surface of the web to improve heat transfer and assist in removing steam from the wet web.

A typical high temperature hood system is shown in FIG. 1. A hooded drying system 21 is disclosed which includes at least two exhaust fans 22*a* and 22*b*. The exhaust fans remove moist air along exhaust ducts 26*a* and 26*b* from the exhaust plenum 28*a* and 28*b* shown in FIG. 1. Fresh air is supplied along fresh air input 25*a* and 25*b*, which is supplied, respectively, to supply fan 23*a* and supply fan 23*b*. Then, the supply air is admitted to burners 24*a* and 24*b* prior to being sent to the supply ducts 29*a* and 29*b* located near the lower portion of the hood system. Then, hot air is provided into the drying zone 30 from nozzles located on the wall of the supply plenum (shown in FIGS. 3–5). Exhaust ducts 27*a* and 27*b* are also shown in FIG. 1, and they assist in transferring the air from the exhaust plenums 28*a* and 28*b* towards the supply fan 23*a* and supply fan 23*b* where a portion of the air is exhausted through exhaust ducts 26*a* and 26*b*, respectively. Exhaust tubes 31 are shown around the periphery of the hood which traverse the supply to remove air into the exhaust plenum 28*a* and 28*b*.

The temperature of the hot air streams is usually between about 500 degrees Fahrenheit and about 1200 degrees Fahrenheit, and in some applications about 800–1000 degrees Fahrenheit. A particularly good temperature range is 850–950 degrees Fahrenheit.

Figure 2:
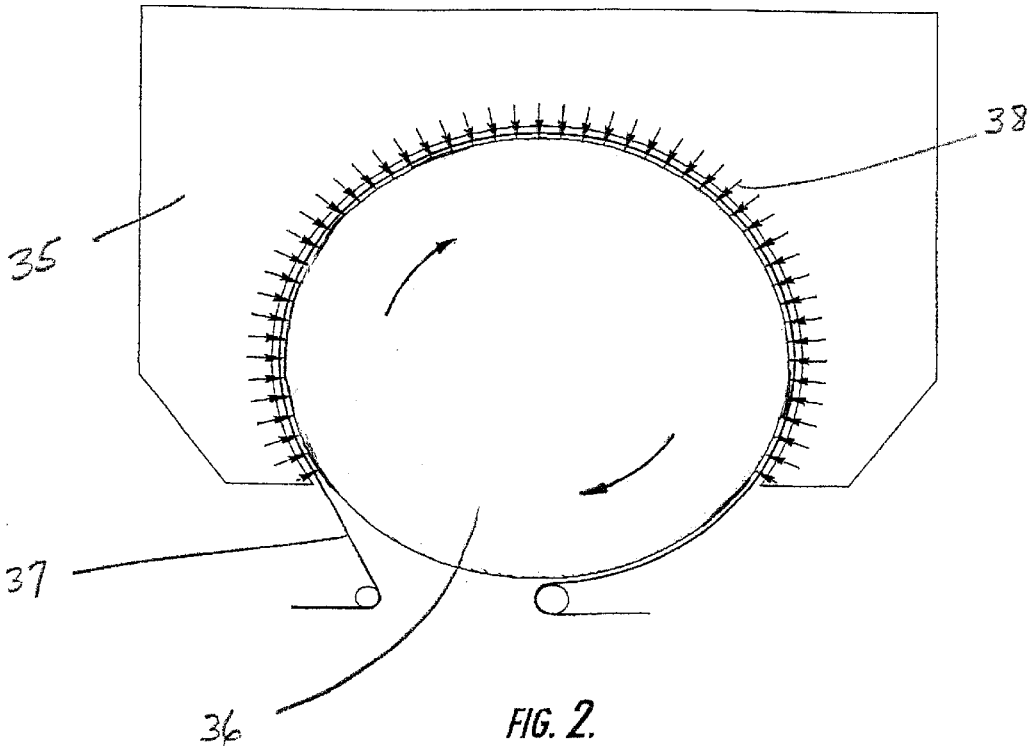
FIG. 2 shows the ejectment of air from the hood onto the surface of the cylindrical dryer.

FIG. 2 shows a basic cross-section of a cylindrical dryer 36 (which may be a Yankee dryer in some applications). In FIG. 2, a dryer hood 35 is shown enclosing a substantial portion of the cylindrical dryer 36, and paper web 37 is shown located between the surface of the cylindrical dryer and the underside of the dryer hood 35. Arrows 38 show the flow of air from the Yankee hood onto the surface of the cylindrical dryer 36.

Figures 3, 3A:
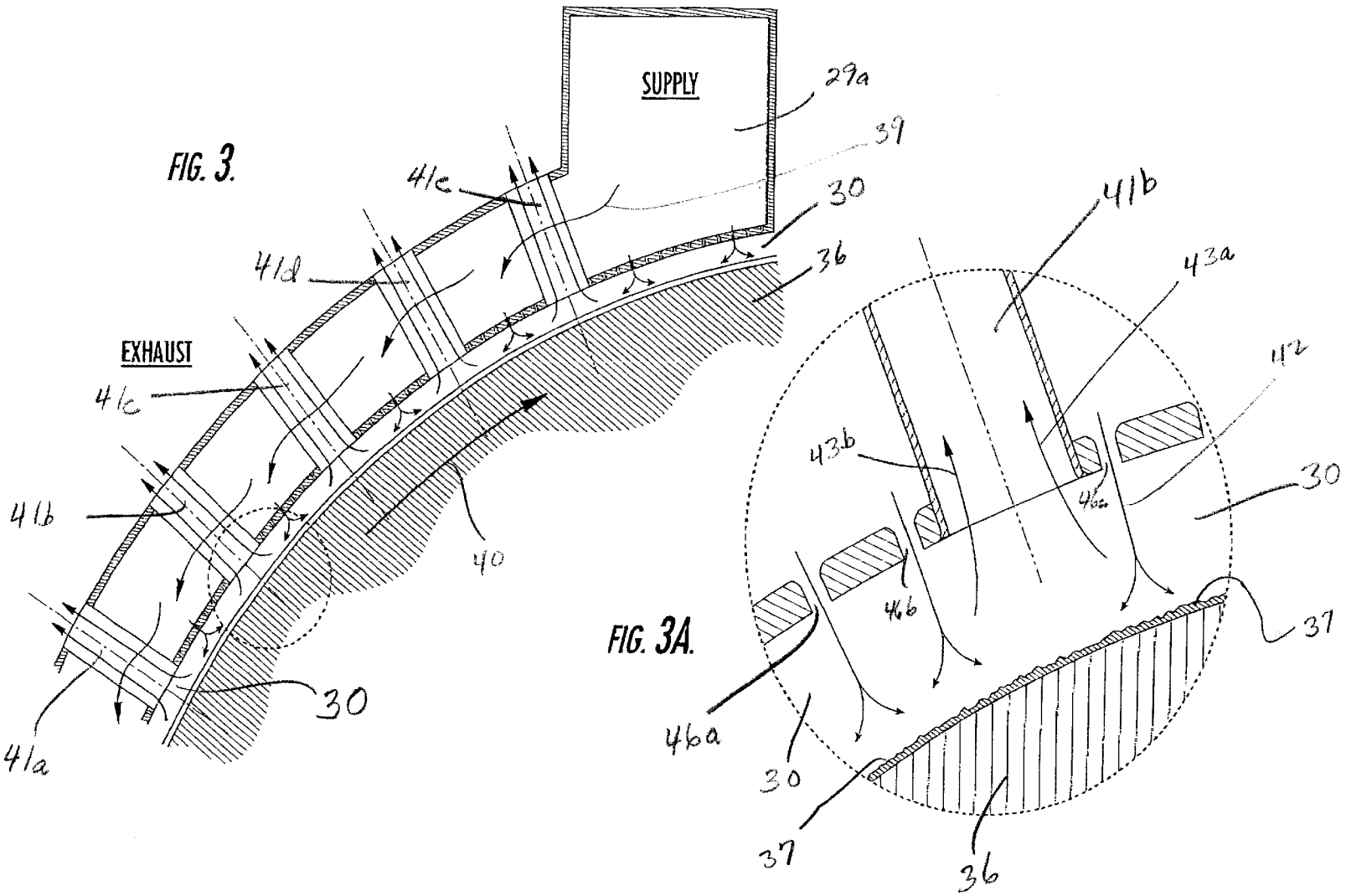
FIG. 3 depicts a more detailed view of air supply ducts and exhaust ducts within the hood.
FIG. 3A shows a closer view of the movement of air near the cylindrical dryer.

Turning to FIG. 3, a cutaway portion of the lower part of a dryer hood on one section of the cylindrical dryer 36 is shown. The supply air is provided along supply arrows 39 as shown near the center of FIG. 3. The air which has been heated to temperatures between about 500 degrees Fahrenheit and about 1200 Fahrenheit is provided. In many cases, the temperature of the air provided is between about 800 degrees and 1000 degrees Fahrenheit, and in many applications will be between about 850–950 degrees Fahrenheit.

The speed of the air stream exiting the dryer hood is typically between about 20,000 to 30,000 ft. per minute. Furthermore, the web travels with a rotational speed, relative to the hood of between about 1,000 to 6,000 ft. per minute.

In FIG. 3, the rotating cylindrical dryer rotates along direction arrow 40, and exhaust tubes 41*a–e* are shown removing moist air from the drying zone 30 just below the supply ducts 29*a* of the dryer hood 35.

In FIG. 3A, an expanded view of a portion of the interface between the drying cylinder 36 and the dryer hood 35 is shown. The drying zone 30 shows the movement of air out of the nozzles 46*a–c* into the drying zone 30. Likewise, moist air is removed from the drying zone 30 along hot air return direction arrows 43*a* and 43*b* shown in the center of FIG. 3A. Hot air is injected along arrows 42 into the drying zone 30. The air returns into exhaust tubes, such as exhaust tube 41*b* which is shown. The paper web 37 is rotating with the cylindrical dryer 36, as shown on the lower right portion of FIG. 3A.

Figure 4:
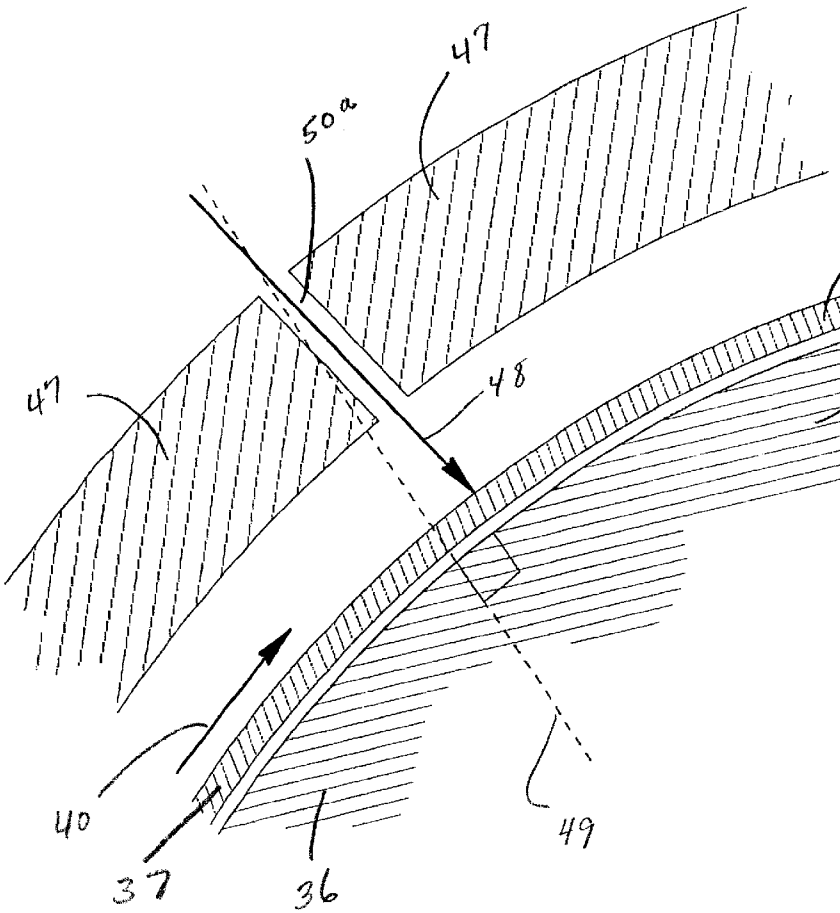
FIG. 4 is a schematic view showing the angle of air ejected from nozzles of the air hood onto the surface of the drying cylinder.
Figure 4A:
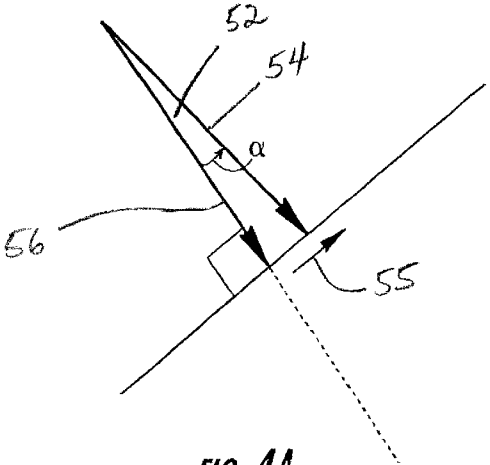
FIG. 4A is a vector diagram showing the resultant air speed vector, which shows the angle alpha deviation from perpendicular.

In FIG. 4, a wall 47 of the supply plenum of the dryer hood is shown with an angled supply nozzle 50*a* shown. As previously described, this air supply nozzle is angled away from the perpendicular line 49 so that it supplies air along air supply direction arrow 48 onto the surface of the paper web 37 in order to dry the paper web 37. The cylindrical dryer 36 rotates along direction 40 as shown in FIG. 4. In FIG. 4A, a vector diagram is shown of the forces at work in the drying system. A air supply vector 54 is shown deviated from perpendicular. Further, alpha angle 52 is shown. A relative velocity vector 56 is shown which is a resulting direction of velocity relative to the surface velocity of the Yankee dryer and wet web. A vector 55 shows the relative velocity of the rotating wet web. The angle of deviation between the air supply vector 54 and the relative speed vector 56 is the lead angle alpha, shown in FIG. 4A. The angle alpha will vary depending upon the range of air velocity and the range of Yankee dryer surface speeds. However, it has been found that for most applications the lead angle alpha is deviated from perpendicular at an angle of between about 5–20 degrees.

The angle alpha may be calculated according to the following formula:

$$\text{sin alpha angle}=W_s/A_n,$$

wherein $W_s$ is the wet web speed and $A_n$ is the approximate speed of the air provided from the nozzle. In many cases the lead angle alpha is between about 5–15 degrees.

Another feature of the invention is that the angled nozzles which are provided to supply hot air from the drying hood to the surface of cylindrical dryer 36 may be angled in another direction (i.e, along another axis that is aligned with the axis of rotation of the dryer; called the beta angle). That is, besides the angle that has been shown in FIG. 4A, an angle in a further direction (beta angle) may be provided to assist in stabilizing the wet web upon the surface of the drying cylinder 36.

Figure 5:
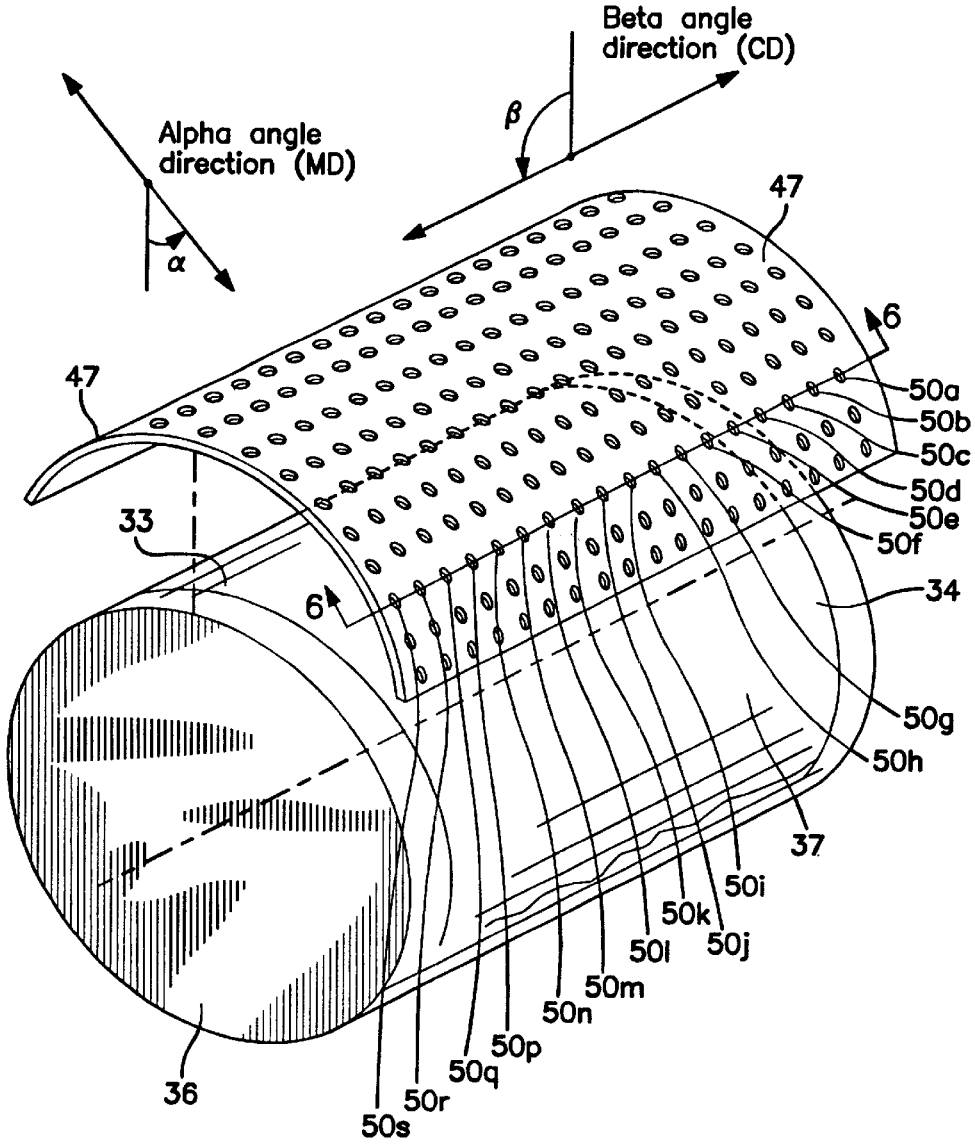
FIG. 5 shows an exploded view of a portion of an air hood pulled out above the surface of a drying cylinder.

Turning to FIG. 5, an illustration of the use of the compound angle of the nozzles is seen. In FIG. 5, angle supply nozzles 50*a–s* are shown across the surface of the wall 47 of a supply plenum of a dryer hood. Although the number of nozzles provided in a hood may be much more than that shown in FIG. 5, this Figure is merely intended to represent the angle of the nozzles and their configuration, and is not intended to limit or be specific as to the exact number or orientation of holes in the hood. Also note that the exhaust tubes 41*a* to 41*e* shown on FIG. 3 are not shown in this view.

Figure 6:
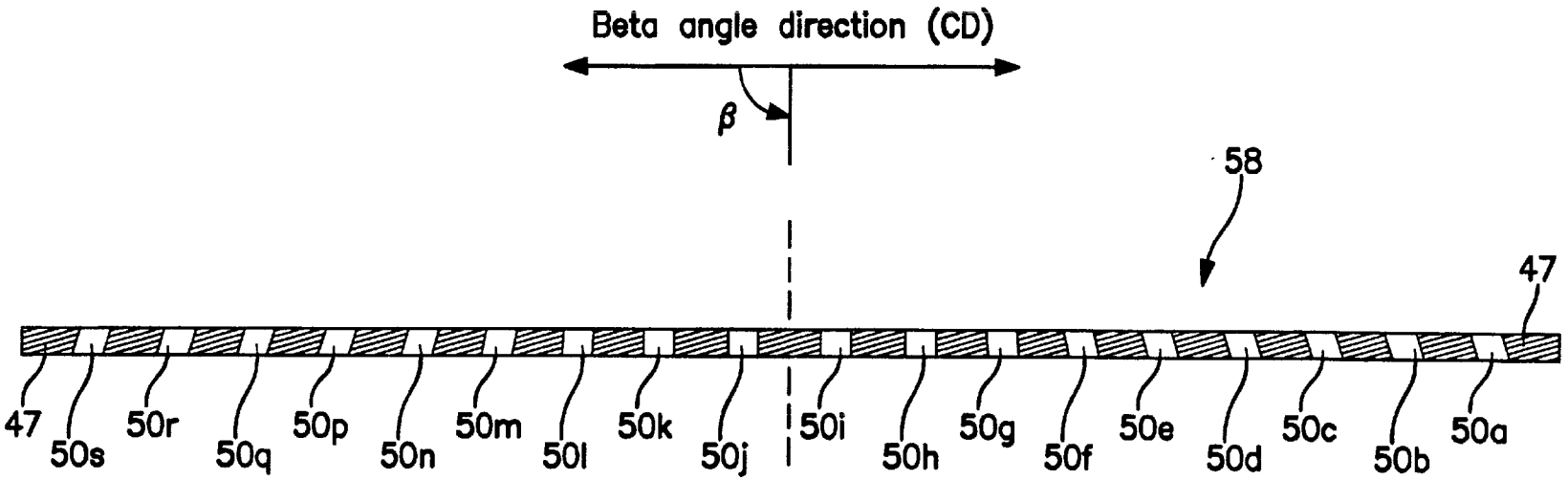
FIG. 6 shows a cross-section of a hood taken along lines 6—6 of FIG. 5, in which nozzles having a compound angle are shown in section view, with nozzles to the left of the midline pointing towards the left margin, and nozzles to the right of the midline pointing towards the right margin of the web.

A compound angle ("beta") may be provided as one optional feature of the invention. A cross-section of the wall 47 of the supply plenum of the dryer hood is shown in FIG. 6. There, the hood 58 with compound nozzle angles is shown. In that Figure, wall 47 is shown from left to right, and a cross-section is taken along lines 6—6 as shown in FIG. 5. In FIG. 6, it can be seen that the nozzles are oriented depending upon where they are located across the surface of the drying cylinder. For example, nozzles 50*i* and 50*j* are approximately perpendicular to the cylinder surface in this direction, so that they provide air directly down upon the surface of the paper web 37 (paper web 37 shown in FIG. 5). However, as one moves further from the mid-line of the paper web, i.e., towards either end of FIG. 6, the beta angle of the nozzles is increased in a direction pointing away from the mid-line.

That is, the paper web 37 is shown having a right edge 34 seen in FIG. 5, and a left edge 33. Thus, the angled supply nozzle 50*a* is shown blowing air upon the right edge 34 of the paper web 37, while the angled supply nozzle 50*s* is shown blowing air upon the left edge 33 of the paper web 37.

Turning to FIG. 6, it is seen that the further the angle supply nozzle is from the mid-line, the more angled the nozzle is in its direction of air flow. This angled air flow results in a compound angle of the nozzle, and assists in pushing the left and right edges of the web out away from the mid-line so as to flatten the wet web upon the surface of the drying cylinder. Furthermore, this stabilizes the wet web upon the surface of the cylinder, and assists in avoiding the undesirable result of disruption of the sheet on the surface of the Yankee dryer. Additionally, the compound angle feature of the nozzles assists in pulling the sheet tightly across the cross-machine direction, thereby counteracting any localized areas or poor sheet adhesion. Thus, the angled nozzles on the edges of the sheet have proven to be particularly effective at adhering the sheet to the surface of the Yankee dryer. This facilitates higher rotational speeds of the cylindrical dryer, which also facilitates higher processing speeds of the overall papermaking operation. Further this allows the use of processes where the adhesion of the sheet to the surface of the Yankee dryer is less than that usually expected. For example, this permits the use of a woven fabric in place of a felt in the Yankee dryer to pressure roll nip.

In some applications, the supply plenum for air is known as a "blow box" or sometimes it is known as a "nozzle box", depending upon the design configuration. A blow box design is typically a single fabricated chamber. A nozzle box design, on the other hand, typically consists of a number of chambers wrapping the cylinder, wherein the chambers are connected by ducts internal to the hood. Thus, either design may be used in the application of this invention.

The exhaust plenum of the invention is typically provided in an arrangement of tubes or slots that run through the supply plenum and thereby facilitate moist air being pulled away from the drying area.

A burner or heat exchanger is provided to supply energy to heat the supply air. High temperature burners are often a major energy consumer in a tissuemaking process, and for machines with steam hoods, heat exchangers, rather than burners, are employed for heating the air.

In most cases it is essential that hoods supply energy efficiently and uniformly to the wet web. The use of angled impingement nozzles as provided in the invention assists in more efficiently drying the wet web, while at the same time stabilizing the wet web upon the surface of the cylindrical dryer.

In one example of the invention, an impingement velocity of about 28,000 feet per minute of air using a sheet speed of about 5,000 ft. per minute results in an alpha angle of approximately 10.28°. The calculation is shown below:

$$\text{sin alpha angle} = \frac{W_s}{A_n}$$

$$\text{sin alpha angle} = \frac{5{,}000\ \text{ft/min}}{28{,}000\ \text{ft/min}}$$

$$\text{Therefore: alpha angle} = 10.28°$$

The alpha angle may be between about 3 and 30 degrees, and in many applications will be between about 5 and 20 degrees. Alpha angles outside this range are possible, but generally for applications that use unique combinations of machine speed and air velocity. One very useful application deploys an alpha angle of about 10 degrees.

Desirable angles are a function of air velocity and machine speed. Useful machine speeds for machines with impingement hoods are typically from 1000 to 6000 ft/min. Air velocities are typically above 20,000 ft/min for more hoods that are employed in recent years. An air velocity of between about 20,000–30,000 ft/min has proved useful. As machines have increased in speed, the velocity of air in the hood has also increased, tending to keep the optimum angle about the same.

Using the lowest air velocity of 20,000 ft/min and the highest machine speed of 6,000 ft/min results in an angle from vertical of 17.5 degrees. Using the highest air velocity of 28,000 ft/min and a low machine speed of 2,000 ft/min causes the angle from vertical to decrease to 4.1 degrees.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A web drying method, comprising:

(a) providing a rotating drying cylinder having an exterior surface;

(b) providing a drying hood adjacent the exterior surface of the drying cylinder, the hood comprising a drying zone of heated air, the hood further comprising nozzles adapted to supply hot air streams into the drying zone;

(c) applying a wet web to the exterior surface of the cylinder;

(d) rotating the wet web upon the exterior surface of the cylinder through the drying zone of the hood; and (e) directing hot air streams from the nozzles upon the wet web, at least one hot air stream being provided from a nozzle at a lead alpha angle that is deviated from perpendicular in the downstream machine direction between about 3 and about 30 degrees.

2. The method of claim 1 further comprising the step of:

(f) adhering the web to the surface of the cylinder while substantially avoiding disruption of the web upon the surface of the cylinder.

3. The method of claim 1 wherein the lead alpha angle is deviated from perpendicular in the downstream machine direction between about 5 and about 20 degrees.

4. The method of claim 1 wherein the lead alpha angle is deviated from perpendicular in the downstream machine direction about 10 degrees.

5. The method of claim 1 wherein the web is traveling at a speed, relative to the hood, of between about 1,000 and 6,000 feet per minute.

6. The method of claim 1 wherein the speed of the air streams exiting the nozzles is between about 20,000 and 30,000 feet per minute.

7. The method of claim 1 in which the temperature of the hot air streams is between about 500 degrees Fahrenheit and about 1200 degrees Fahrenheit.

8. The method of claim 1 in which the temperature of the hot air streams is between about 800 degrees Fahrenheit and about 1000 degrees Fahrenheit.

9. The method of claim 1 in which the temperature of the hot air streams is between about 850 degrees Fahrenheit and about 950 degrees Fahrenheit.

10. The method of claim 1 in which the nozzle direction is angled in the cross direction away from perpendicular towards the edges of the web from the midline, such that said nozzles emit air at a compound angle.

11. The method of claim 10 in which the step of directing the hot air streams comprises directing the streams at a deviation angle from perpendicular in the cross direction that increases as the nozzle distance from the midline increases.

12. A method of drying a paper web upon a drying cylinder using angled air nozzles directed at an angle alpha, comprising:

(a) providing a rotating drying cylinder having an exterior surface;

(b) providing a drying hood adjacent the exterior surface of the drying cylinder, the hood comprising a drying zone of heated air, the hood further comprising nozzles adapted to supply relatively high speed hot air streams into the drying zone of the hood, the nozzles being oriented at an angle deviating from perpendicular in the downstream machine direction designated alpha;

(c) applying a wet web to the exterior surface of the cylinder, the wet web being rotated by the cylinder at a web sheet speed; and (d) rotating the wet web upon the exterior surface of the cylinder through the drying zone of the hood while simultaneously directing hot air streams from the nozzles upon the web; and (e) providing a hot air stream from a nozzle at an angle alpha that deviates from perpendicular according to the following equation:

$$\sin \text{alpha angle} = W_s / A_n;$$

wherein $W_s$ is the wet web speed and $A_n$ is the speed of air provided from the nozzle.

13. A web drying apparatus, comprising:

(a) a rotating drying cylinder, the cylinder having an exterior drying surface adapted to receive a wet web;

(b) an air hood, the air hood comprising an air blowing means capable of providing a stream of high speed heated air upon a wet web on the exterior surface of the drying cylinder, (c) at least one air nozzle connected to the air hood, the air nozzle being oriented to eject air from the hood towards the drying cylinder at a predetermined angle alpha, the angle alpha being deviated from perpendicular in the downstream machine direction between about 3 and about 30 degrees.

14. The apparatus of claim 13 wherein the alpha angle is about 5–15 degrees.

15. The apparatus of claim 13 in which the temperature of the air stream is between about 500 degrees Fahrenheit and about 1100 degrees Fahrenheit.

16. The apparatus of claim 13 in which the temperature of the hot air stream is between about 800 degrees Fahrenheit and about 1000 degrees Fahrenheit.

17. The apparatus of claim 13 in which the temperature of the hot air stream is between about 850 degrees Fahrenheit and about 950 degrees Fahrenheit.

18. The apparatus of claim 13 in which the web further comprises a midline along its middle, the web further comprising a left and right edge, further wherein nozzles of the hood located on either side of the web midline eject hot air upon the web, wherein the direction of air ejected is angled towards the edge of the web in both the left and right directions, respectively, in a compound angle, in the cross direction of the web, thereby pushing the left and right edges of the web away from the midline so as to flatten the web upon the surface of the drying cylinder.

19. The apparatus of claim 18 in which the streams are directed at a deviation angle beta from perpendicular in the cross direction of the web, such that the angle beta increases as the nozzle distance from the midline increases, such that maximum deviation angle is achieved near the left and right edges of the web.

20. The apparatus of claim 18 in which the web is widened due to the compound angle of the nozzles.

* * * * *